US006839042B2

(12) United States Patent
Conemac et al.

(10) Patent No.: US 6,839,042 B2
(45) **Date of Patent: *Jan. 4, 2005**

(54) LIGHT BEAM DISPLAY WITH INTERLACED LIGHT BEAM SCANNING

(75) Inventors: Donald C. Conemac, Simi Valley, CA (US); Eric Harlen Ford, La Canada, CA (US)

(73) Assignee: Advanced Laser Technologies, Inc., Camarillo, CA (US)

( * ) Notice: Subject to any disclaimer, the term of this patent is extended or adjusted under 35 U.S.C. 154(b) by 196 days.

This patent is subject to a terminal disclaimer.

(21) Appl. No.: 10/000,945

(22) Filed: Oct. 24, 2001

(65) Prior Publication Data

US 2002/0050963 A1 May 2, 2002

Related U.S. Application Data

(60) Provisional application No. 60/244,075, filed on Oct. 27, 2000.

(51) Int. Cl.[7] ..... G09G 3/00

(52) U.S. Cl. ..... 345/32; 345/108; 345/110; 359/204; 359/216

(58) Field of Search ..... 345/31, 32, 108, 345/110; 349/57, 62; 359/204, 212, 216, 218

(56) References Cited

U.S. PATENT DOCUMENTS

| | | | | |
|---|---|---|---|---|
| 3,928,759 | A | | 12/1975 | Sansone |
| 4,314,154 | A | | 2/1982 | Minoura et al. |
| 4,563,056 | A | | 1/1986 | Tagawa et al. |
| 4,791,591 | A | | 12/1988 | Asanuma et al. |
| 4,897,715 | A | * | 1/1990 | Beamon, III ..... 348/115 |
| 4,915,484 | A | | 4/1990 | Yamamoto |
| 5,107,364 | A | | 4/1992 | Morimoto et al. |
| 5,115,334 | A | | 5/1992 | Tomita |
| 5,130,838 | A | | 7/1992 | Tanaka et al. |
| 5,148,285 | A | | 9/1992 | Nakane et al. |
| 5,233,457 | A | | 8/1993 | Hamada et al. |
| 5,515,198 | A | | 5/1996 | Kusuda et al. |
| 5,646,766 | A | * | 7/1997 | Conemac ..... 359/204 |
| 5,694,235 | A | | 12/1997 | Kajiki |
| 5,715,021 | A | | 2/1998 | Gibeau et al. |
| 5,874,929 | A | | 2/1999 | Opower et al. |
| 5,946,125 | A | | 8/1999 | Ang |
| 5,990,983 | A | | 11/1999 | Hargis et al. |
| 6,011,643 | A | | 1/2000 | Wunderlich et al. |
| 6,020,937 | A | | 2/2000 | Bardmesser |
| 6,057,964 | A | | 5/2000 | Roeder et al. |
| 6,091,461 | A | | 7/2000 | Bardmesser |
| 6,137,461 | A | | 10/2000 | Deter et al. |
| 6,137,614 | A | | 10/2000 | Endoh |
| 6,140,979 | A | | 10/2000 | Gerhard et al. |
| 6,175,440 | B1 | | 1/2001 | Conemac |
| 6,188,503 | B1 | | 2/2001 | Hisa |
| 6,351,324 | B1 | | 2/2002 | Flint |

* cited by examiner

*Primary Examiner*—Jimmy H. Nguyen
(74) *Attorney, Agent, or Firm*—Myers Dawes Andras & Sherman, LLP

(57) ABSTRACT

A light beam display employing interlaced light beam scanning comprising a display screen having a vertical and a horizontal dimension, a source of a plurality of light beams and an optical path including a movable reflector having a plurality of reflective facets between the display screen and the light beam source. The movable reflector directs the plural light beams to the display screen via one or more facets of the movable reflector to simultaneously illuminate plural different scan lines of the display which are spaced apart by plural non-illuminated scan lines. An optical mechanical element is provided for vertically shifting the light beams so as to illuminate different scan lines of the display screen.

17 Claims, 7 Drawing Sheets

FIG. 1
PRIOR ART
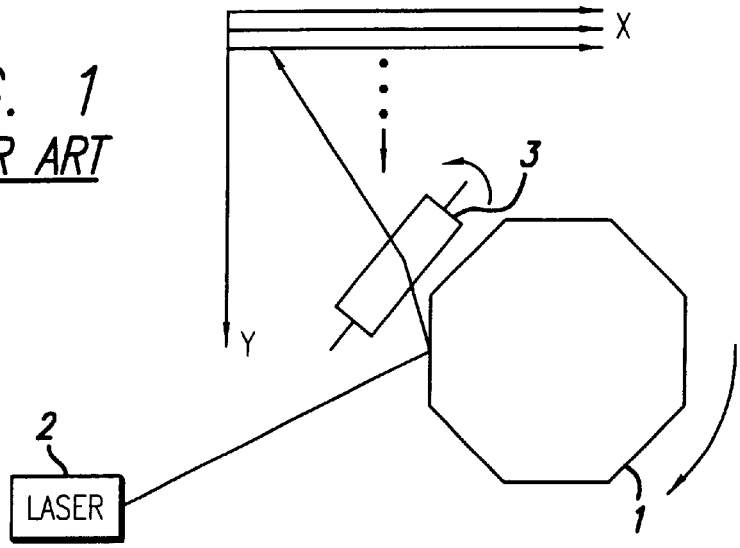
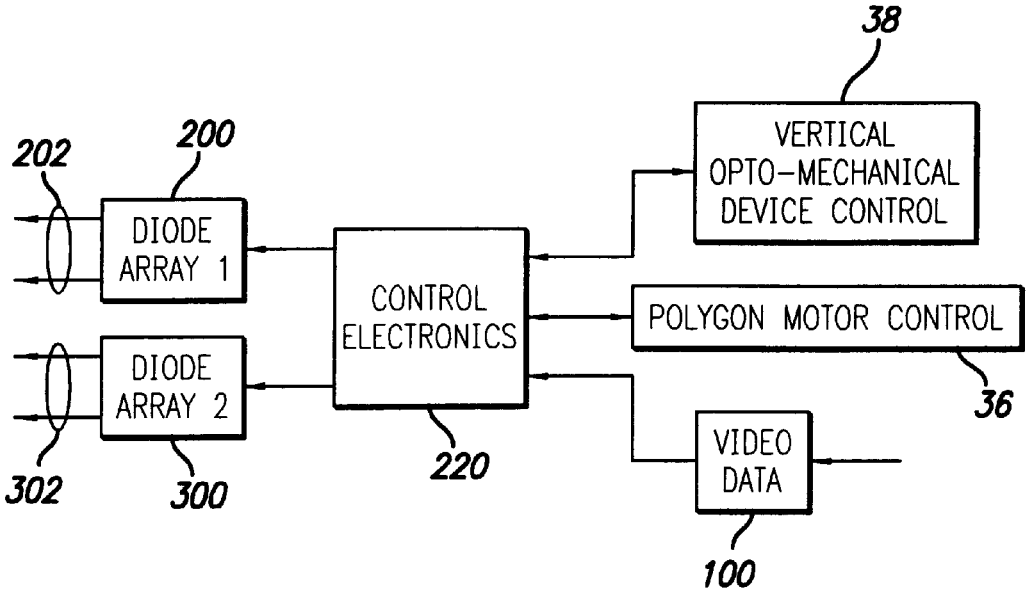
FIG. 2A

FIG. 4A
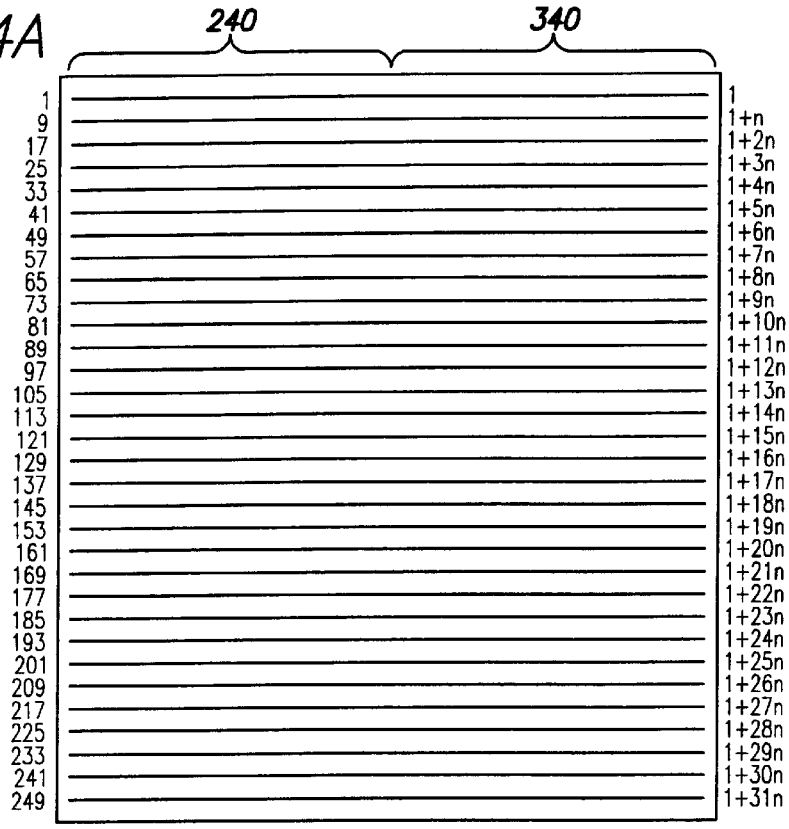
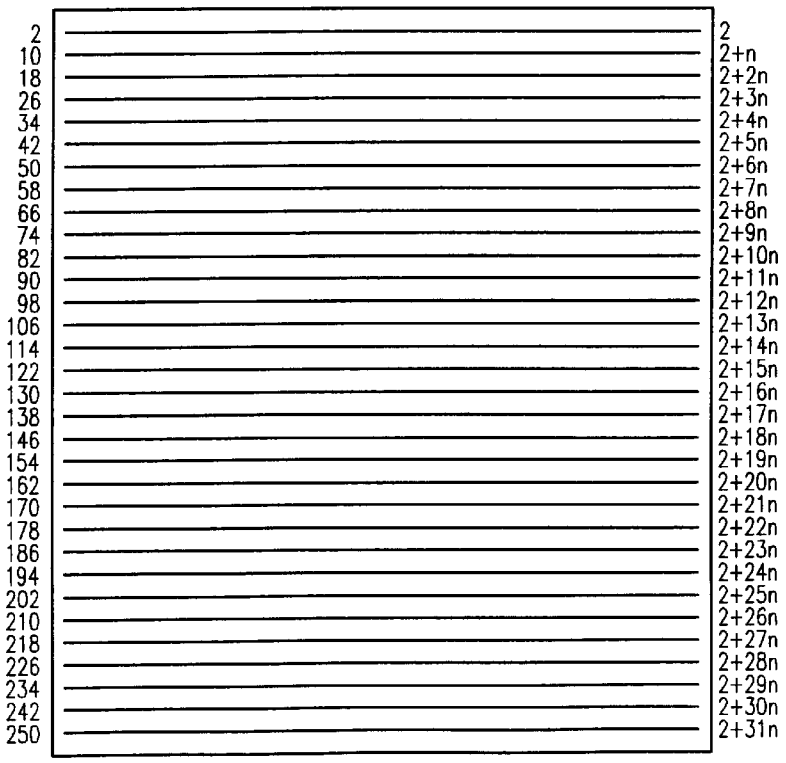
FIG. 4B

FIG. 4C
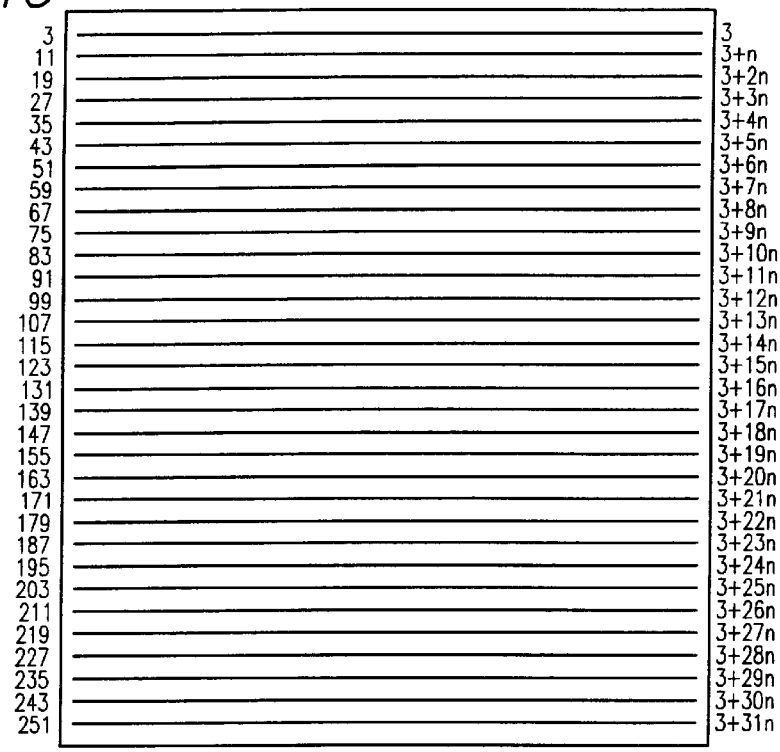
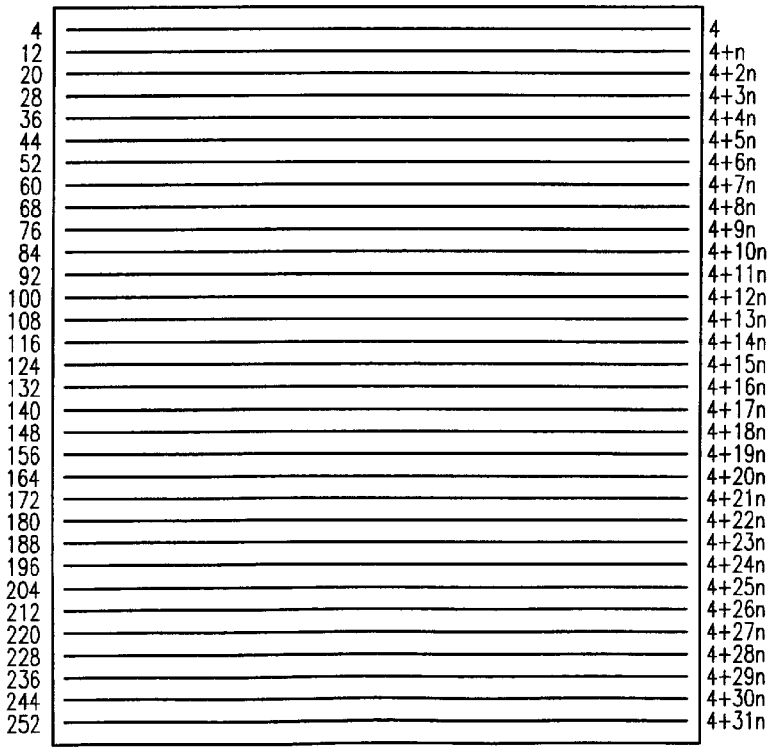
FIG. 4D

FIG. 4E
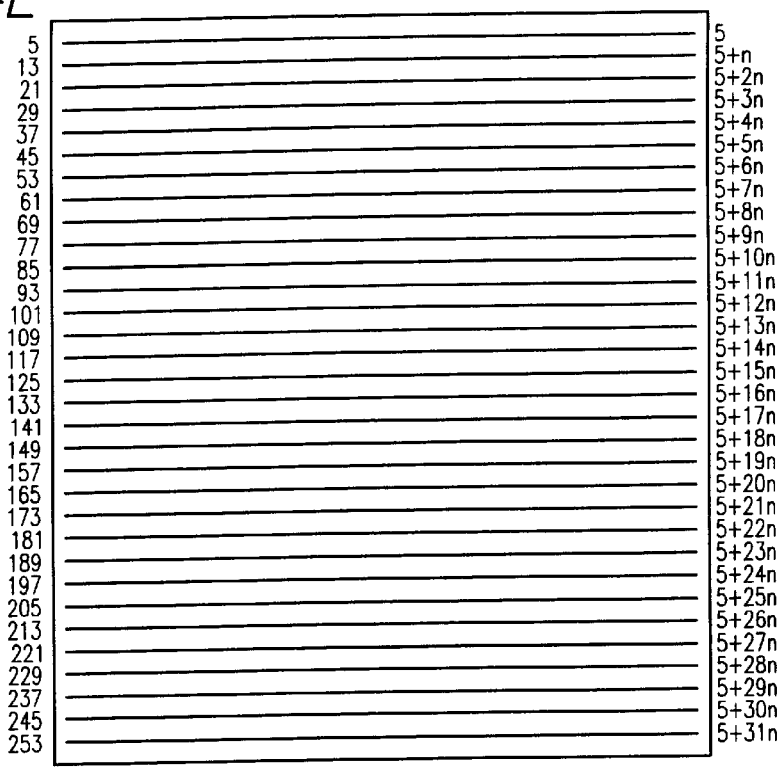
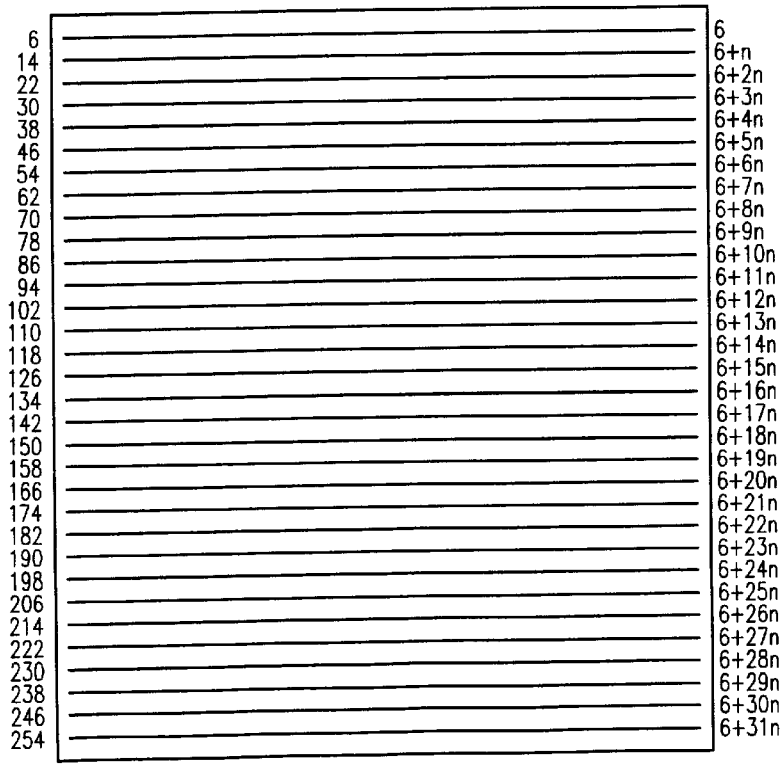
FIG. 4F

FIG. 4G
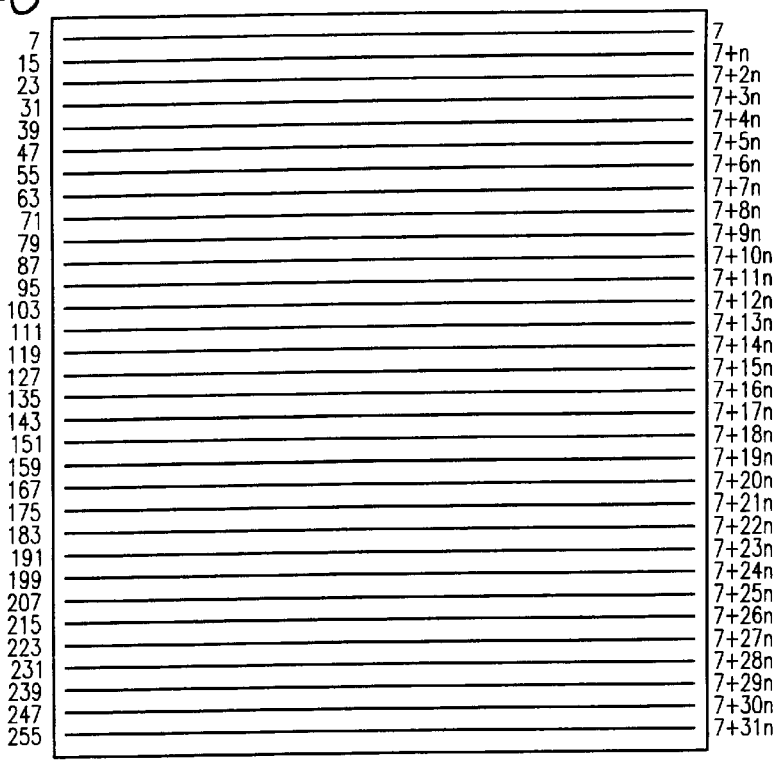
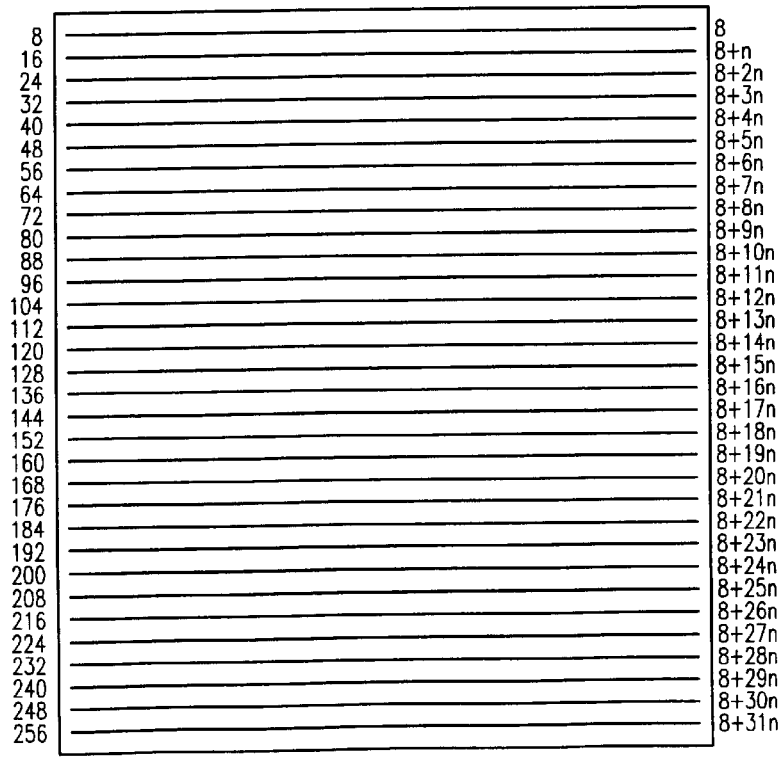
FIG. 4H

LIGHT BEAM DISPLAY WITH INTERLACED LIGHT BEAM SCANNING

RELATED APPLICATION INFORMATION

The present application claims priority under 35 USC 119 (e) to provisional application Ser. No. 60/244,075 filed Oct. 27, 2000, the disclosure of which is incorporated herein by reference.

BACKGROUND OF THE INVENTION

1. Field of the Invention

The present invention relates to displays and methods of displaying video information. More particularly, the present invention relates to light beam displays and methods of scanning light beams to display video information.

2. Description of the Prior Art and Related Information

High resolution displays have a variety of applications, including computer monitors, HDTV and simulators. In such applications, the primary considerations are resolution, maximum viewable area, cost and reliability. Although a number of approaches have been employed including CRT displays, rear projection and front projection displays, plasma displays and LCDs, none of these have been able to satisfactorily provide all the above desirable characteristics. In other display applications, such as control panel displays, and vehicle and aircraft on-board displays, resolution is of less importance than brightness, compact size and reliability.

Although light beam based displays such as light emitting diode or laser beam displays potentially can provide many advantages for displays of both types noted above, such displays have not been widely employed. This is due in large part to limitations in the ability to scan the light beam over the display screen with the needed accuracy. One conventional approach to scanning a laser beam employs a rotating mirror to scan the laser beam in a linear direction as the mirror rotates. Typically, the mirror is configured in a polygon shape with each side corresponding to one scan length of the laser beam in the linear direction. A vertical shifting of the beam may typically be provided by a second mirror to provide a two dimensional scanning such as is needed for a display application.

An example of such a rotating polygon laser beam XY scanner is illustrated in FIG. 1. The prior art laser beam scanning apparatus shown in FIG. 1 employs a polygon shaped mirror 1 which receives a laser beam provided by laser 2 and deflects the laser beam in a scanning direction X as the polygon 1 rotates. A second mirror 3 is configured to shift the beam vertically in the Y direction so as to scan consecutive horizontal lines. The two mirrors thus scan the full X direction and full Y direction, respectively. It will be appreciated by those skilled in the art that as the size of the display and the resolution of the display increase it becomes extremely difficult to maintain the needed precise alignment of the two moving mirrors. Various types of distortion can result which are unacceptable for high resolution applications such as HDTV. These factors present serious problems for providing a commercially acceptable scanned laser or light beam display.

Accordingly, a need presently exists for a scanned light beam display which can provide accurate scanning in both horizontal and vertical directions. Furthermore, a need presently exists for such a display which does not add unduly to the costs of the display.

SUMMARY OF THE INVENTION

In a first aspect, the present invention provides a light beam display comprising a display screen having a vertical and a horizontal dimension, a source of a plurality of light beams and an optical path including a movable reflector having a plurality of reflective facets between the display screen and the light beam source. The movable reflector directs the plural light beams to the display screen via one or more facets of the movable reflector to simultaneously illuminate plural different scan lines of the display which are spaced apart by plural non-illuminated scan lines. An optical mechanical element is provided for vertically shifting the light beams so as to illuminate different scan lines of the display screen. This interlacing of the horizontal scan lines allows the amount of vertical shifting to be minimized allowing very accurate scanning of the entire display area.

Preferably, the movable reflector is a rotatable polygon and the light beam display further comprises a motor for rotating the polygon at a predetermined angular speed thereby bringing successive facets into the optical path so as to intercept the plural light beams. The light beam source preferably comprises a first plurality of light emitting diodes configured in an array comprising a plurality of rows and at least one column. The array may have three columns wherein each column corresponds to a light beam source having a primary color. In one preferred embodiment, employing two panels illuminated on the display screen, the light beam source may further comprise a second plurality of light emitting diodes configured in an array comprising a plurality of rows and at least one column and wherein the optical path directs the plural light beams to the display screen via respective first and second facets of the movable reflector to simultaneously illuminate different horizontal regions, or panels, of the display. The optical mechanical element may comprise a galvanometer or piezo electric device coupled to a second movable reflector.

In a further aspect the present invention provides a light beam display comprising an input for receiving video data, the video data including a plurality of horizontal lines of display information, a display screen, a first plurality of light beam sources configured in an array comprising a plurality of rows and at least one column, and a second plurality of light beam sources configured in an array comprising a plurality of rows and at least one column. A memory stores a plurality of horizontal lines of video data and a control circuit simultaneously activates the light beam sources in accordance with video data from plural horizontal lines stored in said memory, such that each of the activated horizontal lines is spaced apart by plural unactivated horizontal lines. First and second optical paths are provided between the display screen and the first and second plurality of light beam sources, respectively, each comprising a first movable reflector having a plurality of reflective facets and a second movable reflector, for directing the simultaneously activated plural beams to the display screen. The first movable reflector may be shared for the two optical paths and horizontally scans the first and second plurality of light beams. The second movable reflector of each path vertically scan the first and second plurality of light beams so as to sequentially scan all the horizontal lines.

In a further aspect the present invention provides a method of displaying information on a display screen employing a plurality of light beams. The method comprises directing a plurality of light beams to the display screen and scanning the plurality of light beams in a first direction to simultaneously trace out a first plurality of parallel scan lines on the display screen, the first plurality of parallel scan lines being spaced apart in a second direction. For example, 32 parallel scan lines spaced apart by 8 lines may be provided. The method further comprises shifting the plurality of light beams in the second direction and then again scanning the plurality of light beams in the first direction to simultaneously trace out a second plurality of parallel scan lines on the display screen, the second plurality of parallel scan lines being spaced apart in the second direction and interlaced with the first plurality of parallel scan lines. The method comprises repeating the shifting and scanning to trace out a third plurality of parallel scan lines on the display screen, the third plurality of parallel scan lines being spaced apart in the second direction and interlaced with said first and second plurality of parallel scan lines. The entire display screen is illuminated by sequentially repeating the shifting and scanning a plurality of times. For example, for a spacing of 8 scan lines the shifting and scanning are performed 8 times. The display screen may have a generally rectangular configuration and the first direction corresponds to the horizontal dimension of the screen and the second direction corresponds to the vertical dimension of the screen. The horizontal direction may be divided into panels scanned by separate beam sources.

Further aspects of the present invention will be appreciated by the following detailed description of the invention.

BRIEF DESCRIPTION OF THE DRAWINGS

FIG. 1 is a top schematic view of a prior art laser scanning apparatus.

FIG. 2A and FIG. 2B are schematic drawings of a light beam display in accordance with a preferred embodiment of the present invention.

FIGS. 4A–4H are schematic drawings of a scan pattern provided in accordance with a preferred mode of operation of the light beam display of the present invention.

DETAILED DESCRIPTION OF THE INVENTION

Figure 2B:
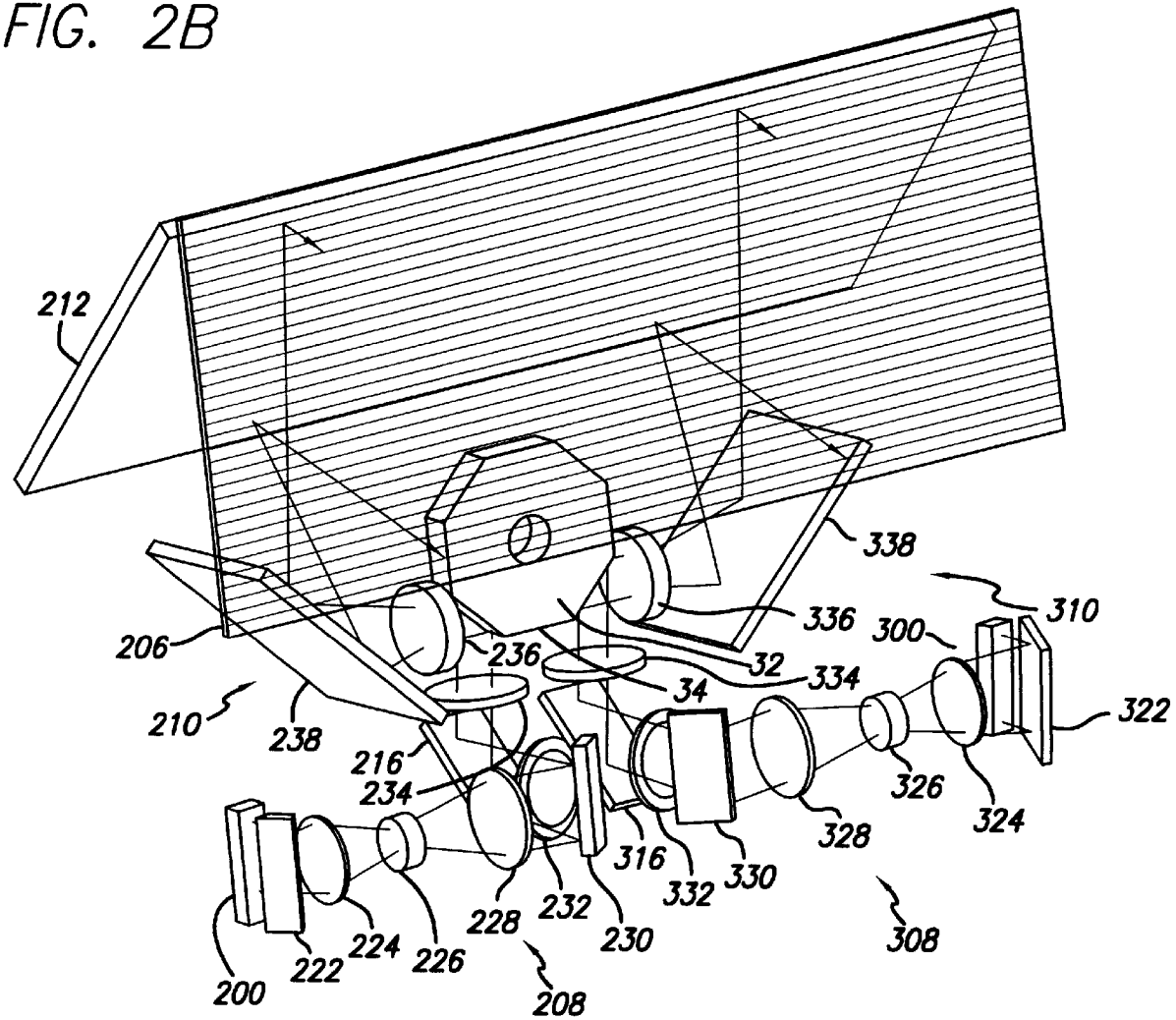

Referring to FIG. 2A and FIG. 2B, a preferred embodiment of the light beam display of the present invention is illustrated in a schematic drawing illustrating the basic structure and electronics of the embodiment. The dimensions of the structural components and optical path are not shown to scale in FIG. 2B, and the specific dimensions and layout of the optical path will depend upon the specific application. The light beam sources, multi-faceted polygon and other optics, and the display electronics may employ the teachings of the U.S. patent application Ser. No. 09/169,163 filed Oct. 8, 1998, now U.S. Pat. No. 6,175,440, issued Jan. 16, 2001, the disclosure of which is incorporated herein by reference. The teachings of U.S. Pat. No. 6,008,925 issued Dec. 28, 1999; U.S. Pat. No. 5,646,766 issued Jul. 8, 1997 and U.S. Pat. No. 5,166,944 issued Nov. 24, 1992; the disclosures of which are incorporated herein by reference, may also be employed. Accordingly, the following will not describe in detail all aspects of the display and reference may be made to the above noted patents for additional details.

The display of FIG. 2A and FIG. 2B includes a first source 200 of a plurality of light beams 202, which plural beams may include beams of different frequencies/colors as discussed in detail below, and a first optical path for the light beams between the light source 200 and a display screen 206. A second source 300 of a plurality of beams 302 is also provided, with a generally parallel second optical path to display screen 206. The beam activation is controlled by control electronics 220 in response to video data from source 100, in a manner described in more detail below. As one example of a presently preferred embodiment, the light sources 200, 300 may each comprise a rectangular array of light emitting diodes having a plurality of rows and at least one column. A monochrome display may have a single column for each diode array whereas a color display may have 3 or more columns. In particular, additional columns may be provided for light intensity normalization. For example, two green columns could be provided where green diodes provide lower intensity light beams than red and blue diodes. A color array thus provides the 3 primary colors for each row. The number of rows corresponds to the number of parallel scan lines traced out on the display screen 206 by each diode array. For example, 32 rows of diodes may be employed. Each two-dimensional diode array 200, 300 may thus provide from 1 to 96 separate light beams 202, 302 simultaneously (under the control of control electronics 220, providing a scan pattern as discussed below). The number of light sources (such as LEDs or fibers) per delivery head 200, 300 may vary depending on the resolution requirements. Other sources of a plurality of light beams may also be employed. For example, a single beam may be split into a plurality of independently modulated beams using an AOM modulator, to thereby constitute a source of a plurality of beams. Such an approach for creating plural beams using an AOM modulator is described in U.S. Pat. No. 5,646,766, incorporated hereby by reference.

The light beam display includes a first movable reflector for horizontal scanning, preferably comprising a multifaceted polygon reflector 32. The numbers of facets on the polygon may correspond to the spacing between simultaneously scanned horizontal lines but may vary depending on the resolution requirements. The polygon shaped reflector 32 is preferably coupled to a variable speed motor which provides for high speed rotation of the reflector 32 such that successive flat reflective facets 34 on the circumference thereof are brought into reflective contact with the light beams. The rotational speed of the reflector 32 is monitored by an encoder (not shown) which in turn provides a signal to motor control circuit 36 which is coupled to the control electronics 220. The motor control circuitry, power supply and angular velocity control feedback may employ the teachings in the above noted U.S. Pat. No. 5,646,766. Although a polygon shaped multi-faceted reflector 32 is presently preferred, it will be appreciated that other forms of movable multi-sided reflectors may also be employed to consecutively bring reflective flat surfaces in reflective contact with the light beams. Such alternate reflectors may be actuated by any number of a wide variety of electromechanical actuator systems, including linear and rotational motors, with a specific actuator system chosen to provide the desired speed of the facets for the specific application. A vertical optical-mechanical device or element 216, 316 for each set of beams 202, 302 provides vertical shifting of the beams under the control of circuitry 38 and control electronics 220. The vertical optical-mechanical device or element 216, 316 may comprise a second movable reflector for each of beams 202, 302. For example, a galvanometer actuated reflector may be employed. Other optical mechanical devices or elements may also be employed, including known piezo electric elements. In an alternate embodiment, vertical shifting of the beams may be provided by tilting the facets on reflector 32. Suitable modifications for such an embodiment will be appreciated from the disclosures of the '440 patent and '075 application incorporated herein by reference.

The optical path for beams 202, 302 from each light beam source 200, 300 is configured such that the light beams intercept the rotating polygon 32 in a manner so as to provide a desired scan range across display screen 206 as the polygon rotates and such that the vertical displacement of the lines is accomplished using the optical mechanical element 216, 316 for each optical path. The optical paths will depend on the specific application and as illustrated may comprise collimating optics 208, 308 and projection optics 210, 310 respectively provided for light beams 202, 302 so as to focus the beams with a desired spot size on display screen 206. Also, the optical paths may employ common (or separate) reflective optical element 212 to increase the path length. Each of collimating optics 208, 308 and projection optics 210, 310 may comprise one or more lenses and one or more reflectors. In the particular illustrated embodiment, collimating optics for the first beam path comprises mirror 222, lens 224, lens 226, lens 228, mirror 230, and lens 232. Collimating optics for the second beam path comprises mirror 322, lens 324, lens 326, lens 328, mirror 330, and lens 332. Collimating optics 208, 308 provide the collimated beams to first vertical optical mechanical element 216 and second optical mechanical element 316, respectively, which may comprise movable reflectors as described above. The beams for the first beam path are then provided, via polygon 32, to projection optics 210 which may comprise lens 236 and mirror 238, which provide the beams to mirror 212 and then to the display screen 206. The beams for the second beam path are in turn provided, via a different facet of polygon 32, to projection optics 310 which may comprise lens 336 and mirror 338, which provide the beams to mirror 212 and then to the display screen 206.

It will be appreciated that a variety of modifications to the optical path and optical elements illustrated in FIG. 2B are possible. For example, additional optical elements may be provided to increase the optical path length or to vary the geometry to maximize scan range in a limited space application. Alternatively, the optical path may not require any path extending elements such as reflective element 212 in an application allowing a suitable geometry of beam sources 200, 300, reflector 32 and screen 206. Similarly, additional focusing or collimating optical elements may be provided to provide the desired spot size for the specific application. In other applications the individual optical elements may be combined for groups of beams less than the entire set of beams in each path. For example, all the diodes in a single row of a diode array may be focused by one set of optical collimating elements. In yet other applications, the focusing elements may be dispensed with if the desired spot size and resolution can be provided by the light beams emitted from the diode arrays 200, 300 itself. The screen 206 in turn may be either a reflective or transmissive screen with a transmissive diffusing screen being presently preferred due to the high degree of brightness provided.

Figure 3:
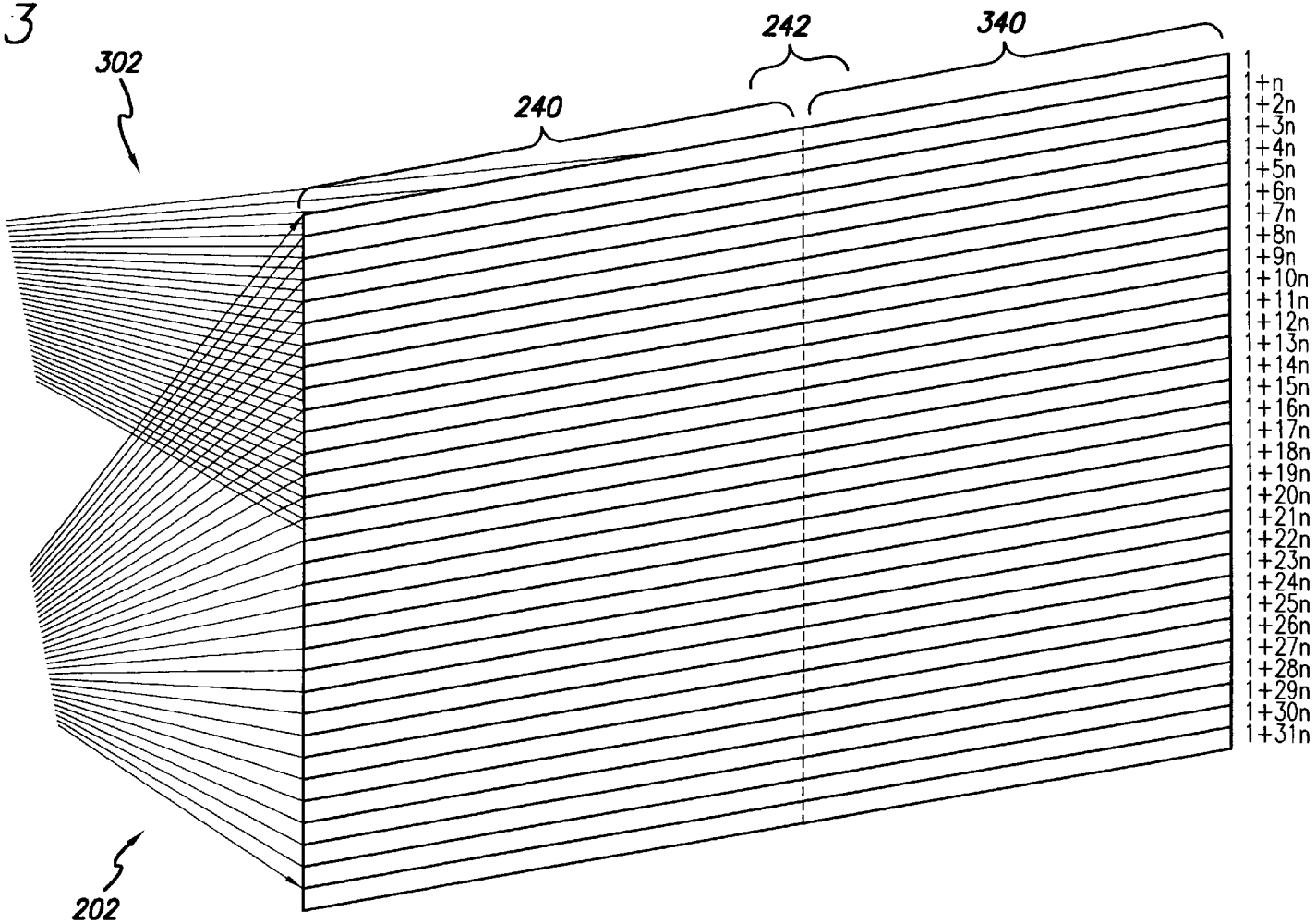
FIG. 3 is a schematic drawing of a scan pattern in accordance with the operation of the light beam display of the present invention.

As further illustrated schematically in FIG. 2A and FIG. 2B and FIG. 3, which illustrates a scan pattern at one vertical position, the optical paths provide the plurality of light beams 202, 302 simultaneously on respective facets 34 of the rotating reflector 32 to illuminate two panels of screen 206. In particular, plural beams 202 are simultaneously directed to respective spots or pixels on a first panel or section 240 of display 206 via a first facet. Plural beams 302 are in turn simultaneously directed to a different set of pixels on a second panel or section 340 of display 206 via a second facet. To provide a seamless image an overlap region 242 may be provided. A plurality of beams from a light source 200 or 300 may also simultaneously illuminate a single pixel. In particular, in a color display all three diodes in a single row of the diode array may simultaneously illuminate a single pixel. Even in a monochrome display application plural beams may be combined at a single pixel to provide increased brightness. This combination of plural beams to a pixel is implied by the beams illustrated generally in FIG. 3 being directed to display 206, each of which preferably includes plural distinct component beams of different frequency or color. The specific manner in which the beams 202, 302 trace out the video data on the screen 206 is shown in FIGS. 4A–H.

FIGS. 4A–H are a sequential illustration of the light beam scan pattern and scanning method provided by the display. Each facet scans a portion of the entire vertical field (32 lines per facet evenly spaced at 8 horizontal lines in this illustrated example). Each of FIGS. 4A–4H represents a new vertical scan position, each comprising plural horizontal scan lines (e.g., 32 as illustrated) scanned by a new facet. The vertical displacement of the lines is accomplished using the respective optical mechanical element 216, 316 for each panel 240, 340. For the illustrated 8 line spacing, the vertical shifting covers only 8 lines. A memory in control electronics 220 stores the plurality of horizontal lines of video data for the entire vertical display. A control circuit in control electronics 220 simultaneously activates the light beam sources in accordance with the video data from plural horizontal lines stored in the memory for a given vertical position, such that each of the activated horizontal lines is spaced apart by plural unactivated horizontal lines as illustrated in each of FIGS. 4A–H. The entire display screen is illuminated by sequentially repeating the vertical shifting and horizontal scanning a plurality of times as shown in FIGS. 4A–H. That is, FIGS. 4A–H cumulatively represent the entire vertical display information. The benefit of this new scan pattern is the very small amount of movement required by the optical mechanical elements 216, 316, e.g., a galvanometer, which enables the horizontal lines to be very straight. It will be appreciated that the choice of spacing between simultaneously scanned horizontal lines (i.e., n=8) in the illustration and the number of simultaneously scanned horizontal lines (i.e., 32) is simply one example and these numbers may be varied for the specific display application.

Some or all of these scanning advantages may also obtain for other applications. Therefore, the interlaced beam scanning optics and scan pattern described herein may be employed for applications other than a display, which require accurate scanning of a light beam.

While the foregoing detailed description of the present invention has been made in conjunction with specific embodiments, and specific modes of operation, it will be appreciated that such embodiments and modes of operation are purely for illustrative purposes and a wide number of different implementations of the present invention may also be made. Accordingly, the foregoing detailed description should not be viewed as limiting, but merely illustrative in nature.

What is claimed is:

1. A light beam display, comprising:

a display screen having a vertical and a horizontal dimension;

a source of a plurality of light beams comprising a first plurality of light emitting diodes configured in an array comprising a plurality of rows and at least one column and a second plurality of light emitting diodes configured in an array comprising a plurality of rows and at least one column;

an optical path including a movable reflector having a plurality of reflective facets between the display screen and the light beam source for directing said plural light beams to the display screen via one or more facets of the movable reflector to simultaneously illuminate plural different scan lines of the display, wherein said simultaneously illuminated scan lines are spaced apart by plural non-illuminated scan lines;

an optical mechanical element for vertically shifting the light beams so as to illuminate different scan lines of the display screen; and a control circuit for simultaneously activating said first and second plurality of diodes;

wherein said optical path directs said simultaneously activated plural light beams to the display screen via respective first and second facets of the movable reflector to simultaneously illuminate different horizontal regions of the display.

2. A light beam display as set in claim 1, wherein the movable reflector is a rotatable polygon and wherein the light beam display further comprises a motor for rotating the polygon at a predetermined angular speed thereby bringing successive facets into the optical path so as to intercept the plural light beams.

3. A light beam display as set out in claim 1, wherein the array has three columns and wherein each column corresponds to a light beam source having a primary color.

4. A light beam display as set out in claim 1, wherein the light beam sources comprise arrays of red, blue and green semiconductor diodes.

5. A light beam display as set out in claim 1, wherein the optical mechanical element comprises a second movable reflector.

6. A light beam display as set out in claim 5, wherein the optical mechanical element further comprises a galvanometer coupled to the second movable reflector.

7. A light beam display as set out in claim 1, wherein the optical mechanical element comprises a piezo electric device.

8. A light beam display, comprising:

an input for receiving video data, the video data including a plurality of horizontal lines of display information;

a display screen;

a first plurality of light beam sources configured in an array comprising a plurality of rows and at least one column;

a second plurality of light beam sources configured in an array comprising a plurality of rows and at least one column;

a memory for storing a plurality of horizontal lines of video data;

a control circuit for simultaneously activating said light beam sources in accordance with video data from plural horizontal lines stored in said memory, each of said activated horizontal lines being spaced apart by plural unactivated horizontal lines; and first and second optical paths between the display screen and the first and second plurality of light beam sources, respectively, comprising a first movable optical element comprising a rotatable reflector having a plurality of reflective facets and a one or more second movable optical elements for directing said simultaneously activated plural beams to the display screen, wherein the first movable optical element horizontally scans the first and second plurality of light beams and the second movable optical element vertically scans the first and second plurality of light beams, respectively, so as to sequentially scan all the horizontal lines.

9. A light beam display as set in claim 8, wherein the light beam display further comprises a motor for rotating the polygon at a predetermined angular speed thereby bringing respective facets into the optical path so as to intercept the plural light beams.

10. A light beam display as set in claim 8, wherein each of the arrays of light beam sources have plural columns which correspond to a different color of light.

11. A light beam display as set out in claim 8, wherein each said simultaneously activated horizontal line is spaced apart by 8 lines.

12. A light beam display as set out in claim 8, wherein the plurality of light beam sources comprise light emitting diodes.

13. A light beam display as set out in claim 8, wherein each array comprises 32 rows of light emitting diodes and 32 lines are simultaneously scanned horizontally.

14. A method of displaying information on a display screen employing a plurality of light beams, comprising:

directing a plurality of light beams to the display screen;

scanning the plurality of light beams in a first direction to simultaneously trace out a first plurality of parallel scan lines on the display screen, the first plurality of parallel scan lines being spaced apart in a second direction;

shifting the plurality of light beams in the second direction;

scanning the plurality of light beams in the first direction to simultaneously trace out a second plurality of parallel scan lines on the display screen, the second plurality of parallel scan lines being spaced apart in the second direction and interlaced with said first plurality of parallel scan lines; and repeating said shifting and scanning to trace out a third plurality of parallel scan lines on the display screen, the third plurality of parallel scan lines being spaced apart in the second direction and interlaced with said first and second plurality of parallel scan lines and wherein the parallel scan lines are separately provided in plural panels in the first direction.

15. A method as set out in claim 14, wherein said display screen has a generally rectangular configuration and wherein said first direction corresponds to the horizontal dimension of said screen and said second direction corresponds to the vertical dimension of said screen.

16. A method as set out in claim 15, wherein the entire display screen is illuminated by sequentially repeating the shifting and scanning a plurality of times.

17. A method as set out in claim 15, wherein the parallel scan lines comprises 32 scan lines.

* * * * *